United States Patent [19]

Grouard

[11] 4,163,448

[45] Aug. 7, 1979

[54] BREATHING APPARATUS

[75] Inventor: Gérard Grouard, Versailles, France

[73] Assignee: La Spirotechnique, Industrielle et Commerciale, Levallois, France

[21] Appl. No.: 721,528

[22] Filed: Sep. 8, 1976

[30] Foreign Application Priority Data

Sep. 15, 1975 [FR] France ..... 75 28202

[51] Int. Cl.[2] ..... A62B 7/02

[52] U.S. Cl. ..... 128/142.2

[58] Field of Search ..... 128/142.2, 142 R, 142.3, 128/145.8, 191 R, 203, 202, 201, 147; 137/61.2; 251/42, 46, 282

[56] References Cited

U.S. PATENT DOCUMENTS

| | | | |
|---|---|---|---|
| 2,854,972 | 10/1958 | Cummins | 128/142.2 |
| 3,249,107 | 5/1966 | Delest | 128/142.2 |
| 3,406,682 | 10/1968 | Engstrom | 128/145.8 |
| 3,434,471 | 3/1969 | Liston | 128/145.8 |
| 3,897,041 | 7/1975 | Gowan | 251/61.2 |
| 4,054,133 | 10/1977 | Myers | 128/142.2 |

FOREIGN PATENT DOCUMENTS

| | | | |
|---|---|---|---|
| 461696 | 6/1928 | Fed. Rep. of Germany | 128/191 R |
| 799635 | 8/1958 | United Kingdom | 128/191 R |

*Primary Examiner*—Henry J. Recla

*Attorney, Agent, or Firm*—Lee C. Robinson, Jr.

[57] ABSTRACT

The present invention concerns closed circuit breathing apparatus comprising a mask having inhalation and exhalation ducts in communication with a regenerator for regenerating exhaled air. A source of air under pressure is connected to the closed circuit so as to feed unused air into the circuit in such a manner as to draw regenerated air to the mask and to maintain a slight over pressure.

8 Claims, 2 Drawing Figures

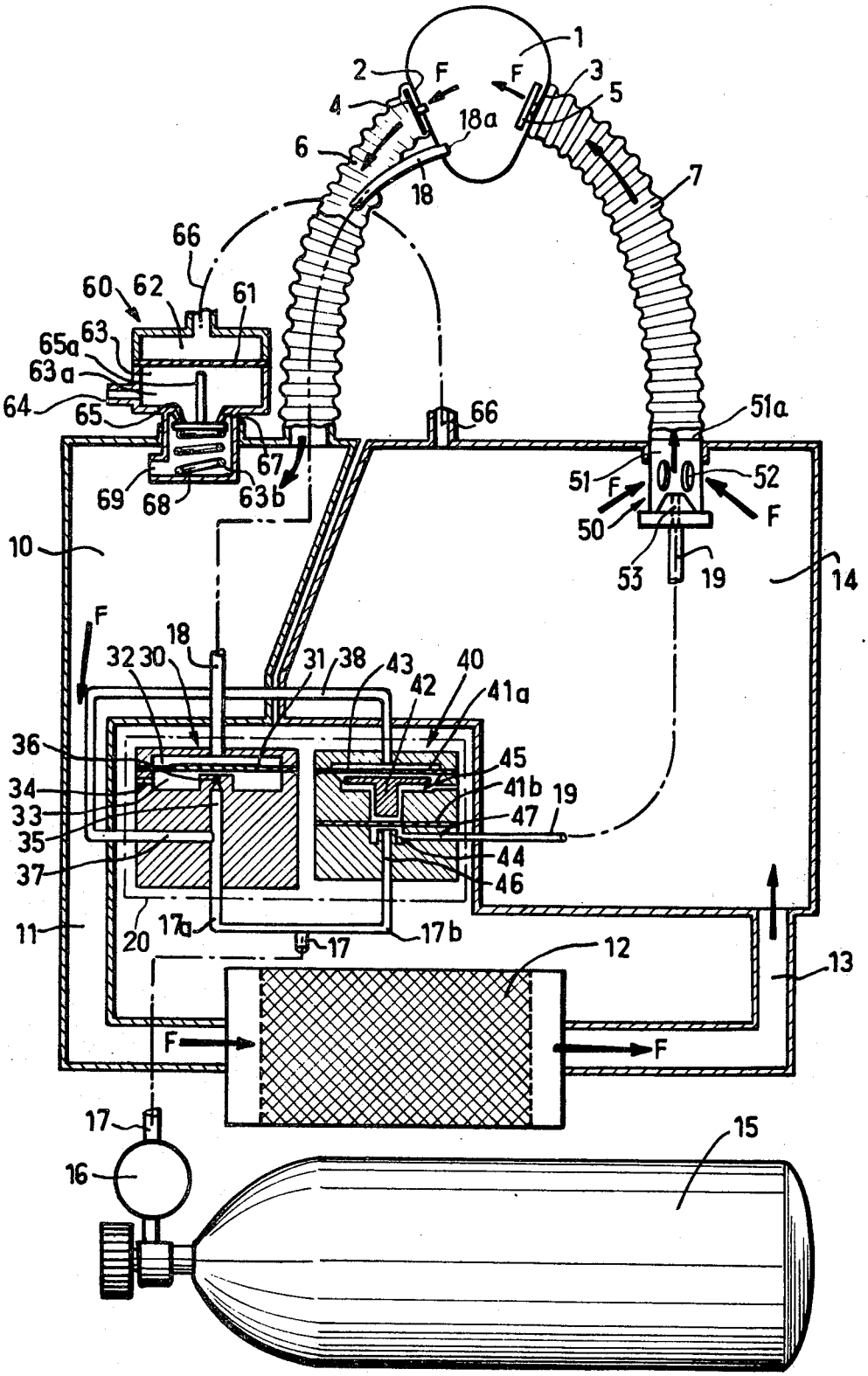
1
2
F
F
3
5
4
18a
6
18
7
66
60
62
61
65a
63
63a
64
65
66
51a
67
69
68
63b
51
F
52
50
F
10
53
19
14
F
18
32
30
31
38
43
42
40
41a
36
45
34
41b
19
33
47
35
44
37
46
11
20
17a
17
17b
12
13
F
F
17
15
16

BREATHING APPARATUS

BACKGROUND OF THE INVENTION

1. Field of the Invention

The present invention concerns breathing apparatus, and is particularly concerned with a breathing apparatus which has: a mask having an exhalation orifice and an inhalation orifice, an exhalation space which communicates with the first orifice via an exhalation duct and receives exhaled air, a regenerating arrangement which is connected to the said space and through which the used air flows, an inhalation space which is connected to the said regenerator so that it may receive regenerated air and, via an inhalation duct to the second orifice mentioned above, a source of unused air under pressure, and means to feed air from the said source into the breathing circuit formed by the mask, the said spaces and the said regenerator in such a way as to draw regenerated air into circulation in the said circuit.

Such apparatus is normally intended for use on the ground to protect persons who have to enter dangerous atmospheres such as radioactive or heavily polluted atmospheres which may be encountered in chemical or nuclear industries in mines, and so on.

2. Description of the Prior Art

In known closed circuit breathing apparatus, in the course of the inhalation phase the pressure of the air in the mask in the region of the mouth becomes lower than the pressure of the external atmosphere. The apparatus in question is thus subject to extremely dangerous leaks and the outside atmosphere, which is often dangerous, may enter the mask and even the entire breathing circuit. In addition, the reduced pressure inside the mask means that there is insufficient breathing air reaching the user, which may cause him considerable inconvenience.

The present invention has as a primary object to overcome these disadvantages. A further object of the invention is to provide a closed-circuit breathing apparatus in which there is a constant over-pressure in the breathing circuit of the apparatus relative to the external medium.

SUMMARY OF THE INVENTION

This object is achieved in the breathing apparatus according to the invention by virtue of the fact that the aforementioned means for feeding unused air into the breathing circuit and for drawing the regenerated air into circulation includes a control device connected to the output from the said source of unused air, which device is sensitive to respiratory pressure in the mask, and an air inducting device which communicates with the inhalation space and is supplied from the said source via the said control device.

The use of a control device which controls the unused air supplied to the air inducting device as a function of respiratory pressure makes it possible for the said air inducting device to be brought into operation during the inhalation phases and thus to maintain the circuit at a slight over-pressure with respect to the external atmosphere. This over-pressure, which may be between 2 and 3 millibars for example, obviates any danger of leakage and thus prevents any of the dangerous external atmosphere from entering the breathing circuit. In addition, the user is assured of a maximum supply of breathing air.

In accordance with another feature of the invention, the control device consists of a pressure detector which is connected to the mask and the source and which is arranged to allow unused air to pass, or to prevent it from so doing, as a function of the pressure in the said mask in the region of the mouth, and of an obturator which is likewise connected to the said source and which is actuated by the said detector so as to control the supply to the air inducting device.

The air inducting device which is slaved to the respiratory cycle provides the user with a maximum flow of air to enable a pressure higher than the external pressure to be maintained.

In accordance with another feature of the invention, the air inducting device is formed by an injector which operates by venturi effect and which communicates on the one hand with the inhalation space and on the other with the inhalation duct, the injection tract of the said injector being connected to the aforesaid obturator.

The injector is supplied with unused air during the inhalation phases and thus is able to convey breathable air to the mask during the said inhalation phases.

Still in accordance with the invention, the two spaces are connected together by a pilot valve which is provided to vent excess used air to the exterior.

The fact of venting used air from the breathing circuit gives the apparatus a better endurance.

BRIEF DESCRIPTION OF THE DRAWING

Other features and advantages of the invention will become apparent from the following description taken in conjunction with the accompanying drawing, which is given by way of non-limiting illustration, of a schematic view of a breathing apparatus according to the invention.

DESCRIPTION OF THE PREFERRED EMBODIMENT

In the embodiment shown, the breathing apparatus has a mask 1 which is provided with an exhalation orifice 2 and an inhalation orifice 3 having non-return valves 4 and 5 respectively. The exhalation orifice 2 is connected to an exhalation duct 6 and the inhalation orifice 3 is connected to an inhalation duct 7. These ducts are preferably formed by flexible corrugated pipes.

The exhalation duct 6 opens into an exhalation space or bag 10 made of a flexible material which communicates via a passage 11 with the upstream end of a regenerator arrangement 12. This regenerator arrangement is formed by a cartridge containing a porous regenerating substance, which may be a peroxidized compound such as potassium superoxide for example which, in the presence of moisture and carbon dioxide gas, produces oxygen, with the result that the said regenerator arrangement, when used air from space 10 is passed through it, retains the carbon dioxide gas and moisture present in the used air and creates additional oxygen thus giving out regenerated air. At its other, downstream end, the regenerator 12 is connected by a duct 13 to an inhalation space or bag 14 which, like the exhalation bag, is made of a flexible material. Finally, the inhalation space 14 communicates with the inhalation tract 7 which is connected to the inhalation orifice 3 of the mask and thus completes the closed breathing circuit. The flow of the exhaled and the regenerated air is represented by arrows in the drawing.

The apparatus also includes a source 15 of unused air which is formed by a bottle containing compressed air or some other breathable gaseous mixture under pressure.

Via a pressure reducer 16 and a duct 17 which divides into two branches 17*a* and 17*b*, the bottle 15 communicates with a control device 20 which in turn communicates via a second duct 18 with the mask 1. Duct 18 opens at 18*a* in the vicinity of the user's mouth. The control device 20 via a third duct 19 communicates with an air inducting device 50 which is housed in the inhalation space 14 and in direct communication with the inhalation tract 7.

The control device 20 is formed by pressure detector 30 and an obturator 40.

The pressure detector 30 is fitted internally with a flexible diaphragm 31 which divides the space within the said detector into two separate compartments 32 and 33. Compartment 32, into which duct 18 opens, is thus in communication with the mask. The wall of the detector has passing through it an orifice or vent 34 which enables compartment 33 to be connected (by means of a pipe which is not shown) to the surrounding atmosphere. A first passage 35, which communicates with branches 17*a* of the duct 17 connected to source 15, opens into compartment 33 via a nozzle 36 which can be blocked by diaphragm 31 and whose diameter is considerably smaller that that of the said passage (is approximately 1/5 thereof). Finally, a second passage 37, to which a duct 38 is connected, enables a connection to be set up between the said pressure detector 30 and the obturator 40.

On the inside, the obturator 40 is fitted with a double flexible diaphragm formed from two elements 41*a* and 41*b*. This double diaphragm divides the space within the obturator into three separate compartments, namely, a first compartment 43 situated above diaphragm 41*a*, a second compartment 44 situated below the lower diaphragm 41*b*, and a central compartment 45 situated between the two diaphragms, in which is housed a pusher or plunger 42 which mechanically connects the said diaphragms together. Compartment 43 communicates with the second passage 37 in detector 30 via duct 38. A passage 46 passes through the wall of the obturator and opens into compartment 44. This passage 46 can be blocked by diaphragm 41*b* and is connected to branch 17*b* of duct 17, which latter is in turn connected to the source 15 of unused air. The wall of the obturator also has passing through it a second passage 47 which connects compartment 44 to device 50 via duct 19.

The air inducting device 50 is formed by a venturi-effect injector and consists of a tubular body 51 provided with lateral orifices 52 and a central injection tract 53. The central tract 53 communicates with passage 47 in obturator 40 via duct 19. The open end 51*a* of the tubular body 51 opens directly into the inhalation tract 7.

Finally, the apparatus includes a so-called overpressure or relief pilot-valve 60 which communicates with the two spaces 10, 14. This valve 60 has internally a flexible diaphragm 61 which divides it into two separate compartments 62 and 63. Compartment 62 communicates with the inhalation space 14 via a duct 66. Compartment 63 is divided into two parts 63*a* and 63*b*, part 63*a* being in communication with the ambient atmosphere via a vent 64 or the like. Communication between parts 63*a* and 63*b* is controlled by a valve 65 whose rod 65*a* is actuated by the flexible diaphragm 61 and is normally pressed against its seating 67 by a calibrated spring 68. Compartment 63*b* communicates directly with the exhalation space 10 via openings such as 69.

The way in which the preferred embodiment of the apparatus described herein operates is as follows:

The user having placed the mask over his face and opened bottle 15, and with diaphragm 31 in the position shown in the drawing, air from the said bottle enters compartment 33 of detector 30 through ducts 17 and 17*a*, passage 35 and nozzle 36 and is able to escape through vent 34. It should be noted that by virtue of its configuration, that is to say the presence of the nozzle or constriction 36 between passage 35 and compartment 33, detector 30 is a device which makes use of the phenomenon whereby gases cling to walls, that is to say that with a low blocking pressure applied to nozzle 36, i.e., to the output from passage 35, the detector is capable of delivering a high control pressure through passage 37. Detector 30 thus supplies a pressure which is very much higher than the pressure reached in the breathing cycle and which can be used to actuate devices which could not be actuated by respiratory pressure alone, in particular to actuate obturator 40.

The pressure in the mask, which varies cyclically with the successive inhalation and exhalation phases, is transmitted via duct 18 to compartment 32 of detector 30 and is thus able to act on diaphragm 31. During an exhalation phase, diaphragm 31 is thrust downwards and presses against nozzle 36 and thus blocks it. The pressure of the unused air is then transmitted via passage 37 and duct 38 to compartment 43 of obturator 40. The effect of this pressure is to thrust element 41*a* of the double diaphragm downwards, which element, via the pusher 42 of the like, thrusts element 41*b* downwards likewise. Passage 46 is thus blocked and the flow of unused air brought in by ducts 17 and 17*b* is stopped. Thus, no unused air is supplied to the air inducting device which is situated downstream of the said obturator.

During the inhalation phase, diaphragm 31 is no longer under stress and moves clear of nozzle 36, which interrups the control pressure which is conveyed through passage 37 and duct 38 to compartment 43 of obturator 40. Since diaphragm 41*a* ceases to be thrust downwards, diaphragm 41*b* moves clear of passage 46 and via passage 47 and duct 19 unused air from bottle 15 reaches the injection tract 53 of the air inducting device 50.

The unused air which is injected in this way into the tubular body 51 through the said tract 53 draws with it the regenerated air contained in the inhalation space 14, this air passing through openings 52 and entering tract 7 to arrive at the mask 1. The air inducting device, which operates by venturi effect and is controlled by the respiratory pressure at the mouth, ensures that there is a constant over-pressure in the breathing circuit during the inhalation phase. The fact that the air inducting device only operates during the inhalation phases, that is to say only at the times when it is needed, has the advantage in comparison with known continuously inducting devices that it enables a reduction to be made in the capacity of the bottle 15 and thus in the weight of the apparatus. The over-pressure prevents any external air from entering the breathing apparatus and because of it the capacity of the said air bottle, which is dictated by the use to which the apparatus is put, can be further reduced for a given endurance. At each inhalation, breathable air is fed to the mask, that is to say regenerated air produced from the exhaled and thus used air, and unused air from bottle 15.

At the next exhalation phase, the operating cycle begins again, that is to say nozzle 36 is again blocked and the supply of unused air to the air inducting device is interrupted.

Valve 60 is provided to vent excess exhaled air to the exterior, this excess being due mainly to the air supplied by source 15, while at the same time ensuring that the inhalation space contains a maximum amount of breathable air. Valve 60, which is situated in the circuit for exhaled air, is controlled by the pressure in the inhalation space. This pressure, which is transmitted by duct 66 to chamber 62, thrusts diaphragm 61 downwards and the diaphragm, in turn and via rod 65*a*, thrusts down valve member 65 in opposition to calibrated spring 68 and lifts valve member 65 from its seating to enable a volume of exhaled gas to flow out corresponding to the excess of air, that is to say to the excessive over-pressure in the inhalation space due chiefly to the infed unused air. The exhaled air passes to the exterior via openings 69 and vent 64. Spring 68 and the valve are so adjusted that the valve opens to allow exhaled air to escape when the pressure in the inhalation space exceeds a certain threshold of overpressure relative to outside pressure which is of the order of two millibars.

Numerous modifications could be made to the embodiment described and shown without thereby exceeding the scope of the invention. Thus, the mask 1 could be replaced for example by a simple bag or a mouthpiece, the air bottle could be replaced by a pressurised evaporator, and so on.

What is claimed is:

1. Apparatus for supplying breathable fluid to a user, the apparatus comprising, in combination:

a mask having an inhalation orifice, an exhalation orifice and a control orifice in the region of the mouth of the user;

means defining an inhalation space;

an inhalation duct interconnecting the inhalation space and the inhalation orifice;

a supply of breathable fluid under pressure;

means including a supply conduit having an infeed end connected to said supply and a discharge end communicating with the inhalation space;

valve means interposed in the supply conduit and being movable in response to the application of fluid pressure between a closed position blocking the flow of unused fluid in said conduit and an open position permitting the passage of unused fluid to said discharge end;

conduit means interconnecting the valve means and the supply of breathable fluid for applying pressure to said valve means to maintain it in its closed position; and a pressure sensing mechanism interposed in the conduit means for regulating the valve means in response to the respiratory pressure in the region of the mouth of the user, the pressure sensing mechanism including a control conduit connected to the control orifice in said mask and means responsive to a decrease in pressure in said mask for moving the valve means to its open position to thereby permit the flow of fluid from the discharge end of the supply conduit.

2. Apparatus for supplying breathable fluid to a user, the apparatus comprising, in combination:

a mask having an inhalation orifice, an exhalation orifice and a control orifice in the region of the mouth of the user;

means defining an inhalation space and an exhalation space;

an exhalation duct interconnecting the exhalation space and the exhalation orifice;

an inhalation duct interconnecting the inhalation space and the inhalation orifice;

regenerating means interconnecting the inhalation space and the exhalation space for regenerating exhaled fluid within said exhalation space and for introducing the regenerated fluid into said inhalation space, to provide a closed breathing circuit;

a supply of unused breathable fluid under pressure;

means including a supply conduit having an infeed end connected to said supply and a discharge end communicating with the inhalation space;

fluid-pressure actuated valve means interposed in the supply conduit for controlling the flow of fluid therethrough, the valve means being movable between a closed position blocking the flow of unused fluid in said conduit and an open position permitting the passage of unused fluid to said discharge end;

conduit means interconnecting the valve means and the supply of unused fluid for applying pressure to said valve means to maintain it in its closed position; and a pressure sensing mechanism interposed in the conduit means for regulating the valve means in response to the respiratory pressure in the region of the mouth of the user, the pressure sensing mechanism including a control conduit connected to the control orifice in said mask and means responsive to a decrease in pressure in said mask for moving the valve means to its open position to thereby permit the flow of fluid from the discharge end of the supply conduit.

3. Apparatus as defined in claim 2, in which the control conduit is in continuous open communication with the interior of the mask.

4. Apparatus for supplying breathable fluid to a user, the apparatus comprising, in combination:

a mask having an inhalation orifice and an exhalation orifice;

means defining an inhalation space and an exhalation space;

an exhalation duct interconnecting the exhalation space and the exhalation orifice;

an inhalation duct interconnecting the inhalation space and the inhalation orifice;

regenerating means interconnecting the inhalation space and the exhalation space for regenerating exhaled fluid within said exhalation space and for introducing the regenerated fluid into said inhalation space, to provide a closed breathing circuit;

a supply of unused breathable fluid under pressure;

means including a supply conduit having an infeed end connected to said supply and a discharge end disposed in the inhalation space;

means disposed in the inhalation space adjacent the discharge end of the supply conduit for drawing regenerated fluid from said inhalation space in response to the discharge of unused fluid from said discharge end and for introducing a mixture of regenerated fluid and unused fluid into said inhalation duct;

valve means interposed in the supply conduit and being movable in response to the application of fluid pressure between a closed position blocking the flow of unused fluid in said conduit and an open position permitting the passage of unused fluid to said discharge end;

conduit means interconnecting the valve means and the supply of unused fluid for applying pressure to said valve means to maintain it in its closed position;

means responsive to a decrease in pressure in said mask for moving the valve means to its open position to thereby permit the flow of fluid from the discharge end of the supply conduit;

pilot valve means communicating with the inhalation space and the exhalation space, the pilot valve means being responsive to excess pressure in the inhalation space to reduce the pressure in the exhalation space, the pilot valve means including a valve chamber and a flexible diaphragm mounted within the chamber dividing the same into two compartments, one of said compartments communicating with the inhalation space and the other compartment communicating with the exhalation space and with the surrounding atmosphere; and a valve disposed in said other compartment for venting the exhalation space in response to the flexing of said diaphragm.

5. Apparatus for supplying breathable fluid to a user, the apparatus comprising, in combination:

a mask having an inhalation orifice and an exhalation orifice;

means defining an inhalation space and an exhalation space;

an exhalation duct interconnecting the exhalation space and the exhalation orifice;

an inhalation duct interconnecting the inhalation space and the inhalation orifice;

regenerating means interconnecting the inhalation space and the exhalation space for regenerating exhaled fluid within said exhalation space and for introducing the regenerated fluid into said inhalation space, to provide a closed breathing circuit;

a supply of unused breathable fluid under pressure;

means including a supply conduit having an infeed end connected to said supply and a discharge end disposed in the inhalation space in close proximity to the inhalation duct;

venturi means disposed adjacent the discharge end of the supply conduit in communication with both the inhalation space and the inhalation duct, the venturi means cooperating with said discharge end to draw regenerated fluid from said inhalation space in response to the discharge of unused fluid from said discharge end and to introduce a mixture of regenerated fluid and unused fluid into said inhalation duct;

diaphragm valve means interposed in the supply conduit and being movable in response to the application of fluid pressure between a closed position blocking the flow of unused fluid in said conduit and an open position permitting the passage of unused fluid to said discharge end;

conduit means interconnecting the valve means and the supply of unused fluid for applying fluid pressure to said valve means to maintain it in its closed position;

means including a pressure sensing mechanism interposed in the conduit means and responsive to a decrease in pressure in said mask for moving the valve means to its open position to thereby permit the flow of fluid from the discharge end of the supply conduit; and said valve means comprises a valve compartment, a pair of flexible diaphragms disposed in said compartment, and means for mechanically interconnecting said diaphragms, the diaphragms being disposed in spaced relationship with each other and dividing the valve compartment into first, second and third separate chambers, said supply conduit having an opening communicating with said first chamber, said third chamber communicating with said conduit means, and the interconnecting means being located in the second chamber.

6. Apparatus for supplying breathable fluid to a user, the apparatus comprising, in combination:

a mask having an inhalation orifice, an exhalation orifice and a control orifice in the region of the mouth of the user;

means defining an inhalation space and an exhalation space;

an exhalation duct interconnecting the exhalation space and the exhalation orifice;

an inhalation duct interconnecting the inhalation space and the inhalation orifice;

regenerating means interconnecting the inhalation space and the exhalation space for regenerating exhaled fluid within said exhalation space and for introducing the regenerated fluid into said inhalation space, to provide a closed breathing circuit;

a supply of unused breathable fluid under pressure;

means including a supply conduit having an infeed end connected to said supply and a discharge end disposed in the inhalation space;

means disposed adjacent the discharge end of the supply conduit in communication with both the inhalation space and the inhalation duct for drawing regenerated fluid from said inhalation space in response to the discharge of unused fluid from said discharge end and for introducing a mixture of regenerated fluid and unused fluid into said inhalation duct;

valve means interposed in the supply conduit and being movable in response to the application of fluid pressure between a closed position blocking the flow of unused fluid in said conduit and an open position permitting the passage of unused fluid to said discharge end;

conduit means interconnecting the valve means and the supply of unused fluid for applying fluid pressure to said valve means to maintain it in its closed position; and a pressure sensing mechanism interposed in the conduit means for regulating the valve means in response to the respiratory pressure in the region of the mouth of the user, the pressure sensing mechanism including a control conduit connected to the control orifice in said mask and means responsive to a decrease in pressure in said mask for moving the valve means to its open position to thereby permit the flow of fluid from the discharge end of the supply conduit.

7. Apparatus for supplying breathable fluid to a user, the apparatus comprising, in combination:

a mask having an inhalation orifice, an exhalation orifice and a control orifice in the region of the mouth of the user;

means defining an inhalation space and an exhalation space;

an exhalation duct interconnecting the exhalation space and the exhalation orifice;

an inhalation duct interconnecting the inhalation space and the inhalation orifice;

regenerating means interconnecting the inhalation space and the exhalation space for regenerating exhaled fluid within said exhalation space and for introducing the regenerated fluid into said inhalation space, to provide a closed breathing circuit;

a supply of unused breathable fluid under pressure;

means including a supply conduit having an infeed end connected to said supply and a discharge end disposed in the inhalation space in close proximity to the inhalation duct;

induction means disposed adjacent the discharge end of the supply conduit in communication with both the inhalation space and the inhalation duct, the induction means cooperating with said discharge end to draw regenerated fluid from said inhalation space in response to the discharge of unused fluid from said discharge end and to introduce a mixture of regenerated fluid and unused fluid into said inhalation duct;

valve means interposed in the supply conduit and being movable in response to the application of fluid pressure between a closed position blocking the flow of unused fluid in said conduit and an open position permitting the passage of unused fluid to said discharge end;

conduit means interconnecting the valve means and the supply of unused fluid for applying fluid pressure to said valve means to maintain it in its closed position, said valve means including means for isolating said conduit means from the unused fluid in said supply conduit passing through said valve mechanism to said discharge end; and a pressure sensing mechanism interposed in the conduit means for regulating the valve mechanism in response to the respiratory pressure in the region of the mouth of the user, the pressure sensing mechanism including a branch circuit communicating with said conduit means and terminating in an opening, a control conduit connected to the control orifice in said mask, a valve compartment and a flexible diaphragm disposed within said compartment dividing the same into first and second separate chambers, said first chamber communicating with the control conduit and said second chamber communicating with said opening in said branch conduit and with the surrounding atmosphere, said diaphragm being located adjacent said opening in said branch conduit to normally block said opening but to flex in response to a decrease in pressure in said mask to unblock said opening and thereby connect said conduit means with the atmosphere, to permit movement of the valve means to its open position and thereby permit the flow of unused fluid from the discharge end of the supply conduit.

8. Apparatus for supplying breathable fluid to a user, the apparatus comprising, in combination:

a mask having an inhalation orifice, an exhalation orifice and a control orifice in the region of the mouth of the user;

means defining an inhalation space and an exhalation space;

an exhalation duct interconnecting the exhalation space and the exhalation orifice;

an inhalation duct interconnecting the inhalation space and the inhalation orifice;

regenerating means interconnecting the inhalation space and the exhalation space for regenerating exhaled fluid within said exhalation space and for introducing the regenerated fluid into said inhalation space, to provide a closed breathing circuit;

a supply of unused breathable fluid under pressure;

means including a supply conduit having an infeed end connected to said supply and a discharge end disposed in the inhalation space in close proximity to the inhalation duct;

venturi means disposed adjacent the discharge end of the supply conduit in communication with both the inhalation space and the inhalation duct, the venturi means cooperating with said discharge end to draw regenerated fluid from said inhalation space in response to the discharge of unused fluid from said discharge end and to introduce a mixture of regenerated fluid and unused fluid into said inhalation duct;

valve means interposed in the supply conduit, the valve means including a valve compartment, a pair of spaced flexible diaphragms disposed in said compartment dividing the same into first, second and third separate chambers, and a plunger positioned in said second chamber and operatively coupled between said diaphragms for transmitting motion therebetween, said supply conduit having an opening communicating with said first chamber, the second chamber being vented to the surrounding atmosphere, one of said diaphragms being located adjacent said opening in position to block the flow of unused fluid in said supply conduit in response to the application of pressure in said third chamber to the other diaphragm;

conduit means interconnecting the third chamber of said valve mechanism and the supply of unused fluid for maintaining said one diaphragm in its blocking position; and a pressure sensing mechanism interposed in the conduit means for regulating the valve mechanism in response to the respiratory pressure in the region of the mouth of the user, the pressure sensing mechanism including a branch conduit communicating with said conduit means, a control circuit in continuous open communication with the control orifice in said mask, a valve compartment and a regulatory flexible diaphragm for dividing the compartment into first and second chambers, said first chamber communicating with the control conduit, said branch conduit terminating in an opening communicating with said second chamber and said second chamber communicating with the surrounding atmosphere, said regulatory diaphragm being located adjacent said opening of said branch conduit to normally block said opening but to flex in response to a decrease in pressure in said mask to unblock said opening and thereby connect said conduit means with the atmosphere, to permit movement of said one diaphragm in the valve means to its unblocking position and thereby permit the flow of unused fluid from the discharge end of the supply conduit.

* * * * *